United States Patent [19]

Bouman et al.

[11] Patent Number: 4,642,520

[45] Date of Patent: Feb. 10, 1987

[54] HIGH PRESSURE DISCHARGE LAMP

[75] Inventors: Anton J. Bouman; Eise B. Geertsema, both of Eindhoven, Netherlands

[73] Assignee: U.S. Philips Corporation, New York, N.Y.

[21] Appl. No.: 154,247

[22] Filed: May 29, 1980

[51] Int. Cl.[4] ..... H01J 7/44; H01J 17/34; H01J 19/78; H01J 29/96

[52] U.S. Cl. ..... 315/73; 315/74; 315/106

[58] Field of Search ..... 315/73, 74, 75, 106; 313/25

[56] References Cited

U.S. PATENT DOCUMENTS

| | | | |
|---|---|---|---|
| 3,458,756 | 7/1969 | Kotsch | 315/74 |
| 4,013,919 | 3/1977 | Corbley | 315/74 |
| 4,195,251 | 3/1980 | Bamberg | 315/73 |
| 4,208,614 | 6/1980 | Strauss et al. | 315/74 |
| 4,233,542 | 11/1980 | Oostvogels et al. | 315/73 |
| 4,305,020 | 12/1981 | Nalepa | 315/73 |

*Primary Examiner*—Saxfield Chatmon
*Attorney, Agent, or Firm*—Robert S. Smith

[57] ABSTRACT

High-pressure discharge lamps generating UV radiation are provided with an internal safety switch, that interrupts the current circuit through the lamp upon fracture of the outer lamp envelope. In lamps according to the invention the safety switch is a member of a material selected from the group consisting of zirconium-aluminum alloys, sintered zirconium powder and sintered mixtures of zirconium powder and nickel powder.

1 Claim, 2 Drawing Figures

HIGH PRESSURE DISCHARGE LAMP

The invention relates to a high-pressure discharge lamp which comprises: a sealed vacuum-tight light pervious lamp envelope, a sealed vacuum-tight light-pervious discharge vessel disposed in said envelope, the space between said envelope and said vessel being evacuated or containing a non-oxidizing gas atmosphere. The lamp further include electrodes disposed in spaced relation from each other within said vessel, an ionizable fill disposed within said vessel, respective electrical current conductors extending through the wall of said envelope and through the wall of said discharge vessel to said electrodes and an oxidation-sensitive element connected electrically in series with said electrical current conductors and disposed in the space between said envelope and said vessel.

Such a lamp is described in copending application No. 952369 filed Oct. 18, 1978 of Oostvolgels et al. The oxidation-sensitive element in this lamp consists of a foil of molybdenum, tungsten, tantalum, zirconium or niobium. The function of the element is to prevent, upon fracture of the lamp envelope, UV radiation from being emitted for a longer period of time and from causing damage to human beings, animals and plants exposed. When air penetrates into the lamp envelope the foil is oxidized, as a result of which the foil breakes and the lamp extinguishes. In order to effect that the lamp extinguishes within a short period of time after fracture of the lamp envelope, however, the foil should have a high temperature. In spite of the fact that the foil is accommodated in the immediate proximity of an electrode, so as to receive as much thermal radiation as possible, the foil is proportioned so that its temperature rises to approximately 700° C. as a result of energy dissipation upon current passage.

A number of proposals for lamps having other safety devices have been made. U.S. Pat. No. 4,090,105 describes a high-pressure discharge lamp having a plurality of incandescent filaments, which are electrically in parallel with each other and in series with the discharge vessel. These incandescent filaments during operation of the lamp are at a temperature between 1000° and 1400° C. and thus are power consuming.

U.S. Pat. No. 4,143,301 teaches a lamp having a first incandescent filament in series with the discharge vessel, wherein a second incandescent filament in series with a thermostatic switch is in parallel with said first incandescent filament. The switch opens where the lamp reaches operating temperatures. In this lamp too the incandescent filament(s) is (are) at a temperature well above 1300° C. and consume(s) considerable power. Moreover an additional switching means is utilized.

U.S. Pat. No. 4,013,919 describes a lamp having an incandescent filament in series with the discharge vessel and a thermal switch in parallel with said incandescent filament, that shunts the filament when the lamp reaches its operating temperature, but opens when air cools the switch upon fracture of the lamp envelope and is open during the starting of the lamp. Thus, also said lamp requires additional switching means and wastes energy during the starting periods.

The Russian Patent Specification No. 267 753 discloses a high-pressure discharge lamp having a cerium foil as an oxidation-sensitive element. The specification states that cerium is pyrophoric. This has for its disadvantage that it involves danger in the production of lamps and requires that special measures be taken upon welding the current conductor to the foil. It is even recommended to provide the foil with a protective coating, which before sealing the lamp envelope is removed from the foil and also from the lamp envelope.

It is the object of the invention to provide a high-pressure discharge lamp having an oxidation-sensitive element, which switches off the lamp upon fracture of the lamp envelope in that the element obtains a high ohmic resistance, wherein the oxidation-sensitive element dissipates no or substantially no electric energy during operation of the lamp. It is another object of the invention to provide such a high-pressure discharge lamp, that does not require additional switching means to avoid substantial energy dissipation of the oxidation sensitive element. It is a third object of the invention to provide such a high-pressure discharge lamp, wherein the oxidation-sensitive element is of a simple construction and gives the lamp designer a large degree of freedom with respect to the place within the lamp envelope where the element is accommodated.

According to the invention, in a high-pressure discharge lamp of the kind mentioned in the opening paragraph these objects are achieved in that the oxidation-sensitive element is a member substantially consisting of a material selected from the group consisting of zirconium-aluminium alloys, sintered zirconium powder and sintered mixtures of zirconium powder and nickel powder.

These materials are sufficiently stable at room temperature to be handled in air, however sufficiently reactive at elevated temperatures of about 300° to 500° C. to give a fast reaction with oxygen. Said reactivity allows the element to be mounted at a suitable place within the lamp envelope and nevertheless to ensure a fast reaction with oxygen present in the air penetrating into the lamp envelope upon fracture thereof, causing the lamp to extinguish. The reaction with oxygen causes the element to become high ohmic or even to fracture within a short period of time of 2 minutes or less.

The member may have the form of a strip, a bar, a ring, a tablet, a pill or any other suitable form. The member may be attached to an electrical current conductor e.g. by clamping, welding or brazing. The member may be self-bearing or be present in a container, for instance be compressed in a cavity formed in a piece of metal band, which may be used to support the discharge vessel within the lamp envelope.

The sintered mixture of zirconium powder and nickel powder preferably consists of at least 65% by weight of zirconium. Sintered mixtures may contain some additional metal powder, such as tungsten powder, e.g. in an amount of up to 10% by weight of the zirconium, to increase its porosity and to speed up the penetration of oxygen into the member.

Preference is given, however, to zirconium-aluminium alloys, especially to those consisting of 70–95% by weight of zirconium and the remainder of aluminium, more specifically the alloy containing 84% by weight of zirconium and that containing of 72% by weight of zirconium.

Whereas the use of a solid zirconium wire or foil as an oxidation-sensitive element for use as a safety switch requires an accurate dimensioning of the element so as to ensure incandescence during operation of the lamp and to prevent the element to fuse, specifically during starting the lamp, it was found by experimentation that the members used in the lamp according to the invention may be dimensioned so as to dissipate no or substantially no electric energy and nevertheless to provide fast and reliable switching off means.

Embodiments of a high-pressure discharge lamp according to the invention is shown in the drawing.

Figure 1:
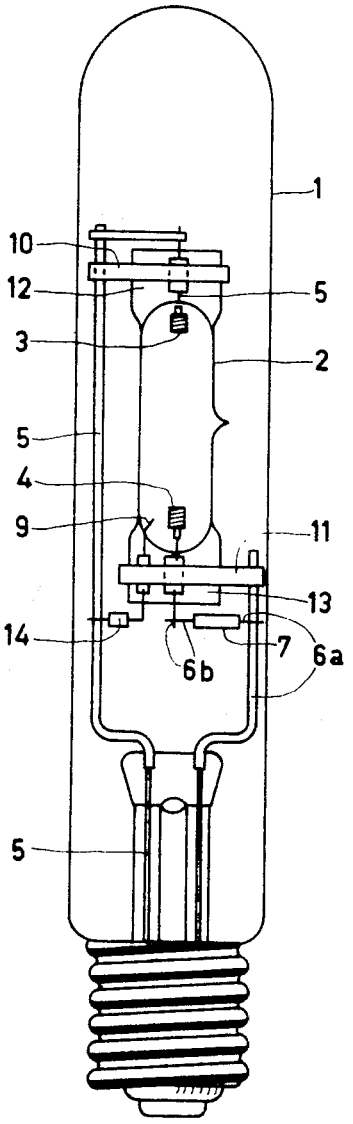
FIG. 1 is a side elevation of a first embodiment.

In FIG. 1, a discharge vessel 2 of quartz glass in which electrodes 3, 4 are present is situated in a glass envelope 1. Current conductors 5 and *6a*, *6b* extend in a vacuum-tight manner through the wall of the outer envelope 1 and the wall of the discharge vessel 2 to the pair of electrodes 3, 4. The current conductor *6a*, *6b* is interrupted so as to incorporate therein an oxidation-sensitive element 7 connected electrically in series with the current conductors 5 and *6a*, *6b*.

An ignition electrode 9 is connected to the current conductor 5 via a resistor 14 with positive temperature coefficients. Metal bands 10 and 11 which are connected to the current conductors 5 and 6 respectively, are wound around the pinch seals 12 and 13, respectively, of the discharge vessel 2 so as to keep this fixed.

The lamp of FIG. 1 is a 250 W high pressure mercurcy lamp. The oxidation-sensitive element 7 is a strip of zirconium-aluminium alloy (weight ration Zr/Al=84/16). Twenty minutes after the lamp was started, the lamp envelope was fractured. The lamp extinguished within two minutes thereafter.

Figure 2:
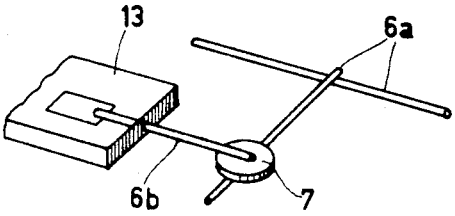
FIG. 2 is a detail of a second embodiment.

In FIG. 2 the oxidation sensitive element 7 is a tablet formed by compressing 70% by weight of zirconium powder and 30% by weight of nickel powder at a pressure of $10^4$ N $cm^{-2}$ and sintering for 1 hour at a temperature of 900° C.

EXAMPLE

In the lamp envelope of a 125 W high pressure mercurcy vapor discharge lamp a sintered ring of zirconium powder was mounted, manufactured by compressing zirconium powder at a pressure of $10^4$ N $cm^{-2}$ and sintering the compressed powder for 1 hour at 900° C. The ring was 2 mm thick, had an inner diameter of 4 mm and an outer diameter of 8 mm. The two free ends of an interrupted current conductor were bent to form hook shaped ends. The ends were hooked into the ring, to suspend the ring under tensile force. Twenty minutes after starting the lamp, the lamp envelope was fractured. The zirconium ring had a temperature of 300° C. by then. The lamp extinguished within 1 minute after fracture of the envelope.

What is claimed is:

1. A high-pressure discharge lamp which comprises: a sealed vacuum-tight light pervious lamp envelope, a sealed vacuum-tight light-pervious discharge vessel disposed in said envelope, the space between said envelope and said vessel being evacuated or containing a non-oxidizing gas atmosphere, said lamp further including electrodes disposed in spaced relation from each other within said vessel, an ionizable fill disposed within said vessel, respective electrical current conductors extending through the wall of said envelope and through the wall of said discharge vessel to said electrodes and an oxidation-sensitive element connected electrically in series with said electrical current conductors and disposed in the space between said envelope and said vessel wherein the oxidation-sensitive element is a member substantially consisting of a material selected from the group consisting of zirconium-aluminium alloys, and sintered zirconium powder and sintered mixturs of zirconium powder and nickel powder.

* * * * *